US008104109B2

(12) United States Patent
Juracek

(10) Patent No.: US 8,104,109 B2
(45) Date of Patent: Jan. 31, 2012

(54) MOVABLE FLOOR SYSTEM FOR SWIMMING POOL

(75) Inventor: Frédéric Juracek, Mareuil les Meaux (FR)

(73) Assignee: Frédéric Juracek, Mareuil les Meaux (FR)

( * ) Notice: Subject to any disclaimer, the term of this patent is extended or adjusted under 35 U.S.C. 154(b) by 228 days.

(21) Appl. No.: 12/406,254

(22) Filed: Mar. 18, 2009

(65) Prior Publication Data

US 2009/0235446 A1 Sep. 24, 2009

(30) Foreign Application Priority Data

Mar. 19, 2008 (FR) ..... 08 51760

(51) Int. Cl.
*E04H 4/00* (2006.01)

(52) U.S. Cl. ..... 4/495; 4/498; 4/504

(58) Field of Classification Search ..... 4/495, 501, 4/506, 496, 504, 499, 498, 503; 52/29; 187/205
See application file for complete search history.

(56) References Cited

U.S. PATENT DOCUMENTS

| | | | | |
|---|---|---|---|---|
| 3,091,777 | A | 6/1963 | Pearlson | |
| 3,435,465 | A | 4/1969 | Formel | |
| 4,106,134 | A * | 8/1978 | Schiron et al. | 4/495 |
| 4,271,542 | A * | 6/1981 | Wood et al. | 4/495 |
| 4,712,788 | A * | 12/1987 | Gaudreau, Jr. | 482/54 |
| 4,831,672 | A * | 5/1989 | Niimura | 4/495 |
| 4,937,896 | A | 7/1990 | Niimura et al. | |
| 5,025,512 | A * | 6/1991 | Niimura | 4/495 |
| 5,043,060 | A * | 8/1991 | Brennan | 210/122 |
| 5,469,936 | A * | 11/1995 | Lauga et al. | 187/205 |
| 6,361,131 | B1 * | 3/2002 | Powell, Jr. | 312/312 |
| 6,502,667 | B1 * | 1/2003 | Mead et al. | 187/214 |
| 6,640,504 | B2 * | 11/2003 | Pearlson et al. | 52/66 |
| 2008/0175704 | A1 * | 7/2008 | Rockwood | 415/111 |

FOREIGN PATENT DOCUMENTS

| | | |
|---|---|---|
| AU | 2282577 A | 9/1978 |
| FR | 2823239 A | 10/2002 |

* cited by examiner

*Primary Examiner* — Dinh Nguyen
*Assistant Examiner* — Jennifer Gordon
(74) *Attorney, Agent, or Firm* — Stroock & Stroock & Lavan LLP

(57) ABSTRACT

A movable floor system for a swimming pool, including a structural platform comprising a horizontal frame designed to support a finished covering, the platform being designed to be installed in a cavity acting as the swimming pool. The system includes a lifting mechanism, a plurality of parallel cross-members fixed within a layer formed by the frame of the platform; and a plurality of carrier pulleys located along outer lateral edges of the frame, the carrier pulleys designed to accommodate a platform-driving cable. The lifting mechanism further includes: a driver; a shaft; first and second drive pulleys situated at the ends of the shaft designed to take at least one platform-driving cable; an attachment to secure at least one cable in the cavity; and means for actuating the drive shaft.

16 Claims, 3 Drawing Sheets

MOVABLE FLOOR SYSTEM FOR SWIMMING POOL

CROSS-REFERENCE TO RELATED APPLICATION

The present application claims the benefit to French Patent Application Serial No. 0851760, filed Mar. 19, 2008, which is hereby incorporated by reference in its entirety.

TECHNICAL FIELD

The present invention relates to movable floor systems for swimming pools. More specifically it relates to a movable floor system designed to be installed in cavities initially used as a swimming pool. The field of the invention applies to cavities, usually water-filled, designed either as indoor swimming pools or equally as outdoor swimming pools.

The system according to the invention allows the cavity to be used notably in two ways, with the movable floor raised or lowered, corresponding to a closed position and an open position, respectively, of the cavity.

In the open position the movable floor is on the floor of the cavity and the cavity can therefore be used as a swimming pool. In the closed position the movable floor is joined to the edge of the swimming pool in such a way as to form a flat surface suitable for pedestrian traffic, just like any floor usually employed in dwellings or paved outdoor spaces.

BACKGROUND OF THE INVENTION

The prior art already includes a number of different movable floor systems for swimming pools which allow a water-filled cavity functioning as a swimming pool to be transformed into a flat surface able to take traffic. Thus, there exist notably platforms which can be moved from a low position, in which they form the floor of the swimming pool, to a high position, in which they form a walk-on floor, or from the high position to the low position. Some platforms can also be at intermediate level as a means of adjusting the depth of the swimming pool for special uses.

However, the existing systems have certain drawbacks.

In the first place, the manufacture of the platforms is complicated and expensive because of the large number of different parts that have to be assembled. These platforms usually consist, notably, of a mesh, in most cases of metal, made up of long parallel longitudinal bars, with short transverse elements having to be fixed between two consecutive longitudinal bars. Consequently the number of transverse elements is very large, hence requiring time and adding to the complexity of producing such a mesh.

In the second place it is often desirable to connect the platform to a pulling and/or pushing system to raise or lower the surface which can thus act alternately as the floor of the swimming pool or as a walk-on floor. A pushing or pulling system of this kind is usually voluminous, and its installation at the bottom of the swimming pool makes for a not-insignificant loss of volume of the part of the cavity that can actually be used as a swimming pool.

Besides this, there are devices described notably in U.S. Pat. No. 2,823,239 providing a structure comprising a platform made up of parallel beams and parallel crossmembers allowing a movable swimming pool floor to be raised and lowered. However, such a device has the drawback of being heavy and requiring a large amount of energy to raise it.

Another drawback is its structure, comprising two superimposed layers, making it voluminous, cumbersome and expensive.

SUMMARY OF THE INVENTION

The system according to the invention solves the problems described above, notably by providing a platform acting as a movable swimming pool floor comprising a frame and crossmembers forming one single layer. This solution has the advantage of providing a movable floor of low height in which a motor is built into a sealed box in such a way that it does not project above or below the frame. The motor may be a winch motor, for example, capable of raising and lowering the platform by means of cables.

Such a system is simple to use yet very safe, and, notably, occupies much less space.

Advantageously, the movable floor system for swimming pool comprises a structural platform comprising a basically horizontal frame forming a layer designed to take a finish covering and comprising a plurality of crossmembers, the platform being designed to be installed in a cavity acting as a swimming pool.

Advantageously, the system comprises:

- lifting means having:
  - at least one drive means;
  - at least one shaft;
  - at least two pulleys, termed "drive pulleys", situated at the ends of the shaft to take platform-driving cables;
  - securing means for securing at least four cables in the cavity acting as the swimming pool;
  - and means for actuating the drive shaft;
- and a plurality of pulleys for actuating the cables, these "carrier pulleys" being located on the outer lateral edges of the frame.

The frame is advantageously formed by two lateral beams and two transverse crossmembers at the edges of the movable floor. The drive means is advantageously mounted within the frame between two crossmembers, the dimensions of the drive means in a direction perpendicular to the plane of the frame being less than the height of the frame.

The drive means is advantageously a winch motor enabling the movable floor to be driven at in the cavity acting as a swimming pool.

The actuating means advantageously enable the movable floor to be positioned at a desired depth, this depth being between the floor of the cavity and the horizontal surface extending from the edge of the cavity.

The motor is advantageously held in a sealed box, the seal being nitrogen.

It advantageously comprises a dual drive for lowering and raising the frame by winding the cables multiple times around the drive pulleys.

It advantageously comprises means for stabilizing the movable floor 1 laterally during its translational movements.

The means for lateral stabilization advantageously comprise a system of brushes arranged along a lateral outline of the platform to ensure contact between the platform and the walls of the cavity.

The platform advantageously comprises a door.

The crossmembers are advantageously fixed to the frame of the platform by means of nuts.

A finish covering advantageously covers the crossmembers fixed to the frame.

The finish covering advantageously comprises openings allowing sufficient water to pass through so that the mobility of the system is not hampered.

A grating is advantageously fixed along the lateral frame of the movable floor to prevent a foreign body getting between the edge of the cavity and the movable floor while still allowing water to pass through during lowering and raising operations.

In the closed position, the distance between the covering of the movable floor and the edge of the swimming pool is advantageously less than 1 cm.

BRIEF DESCRIPTION OF THE DRAWINGS

Other features and advantages of embodiments of the invention will be made apparent by the following description, which is given with reference to the appended drawings showing.

DETAILED DESCRIPTION OF THE INVENTION

Figure 1:
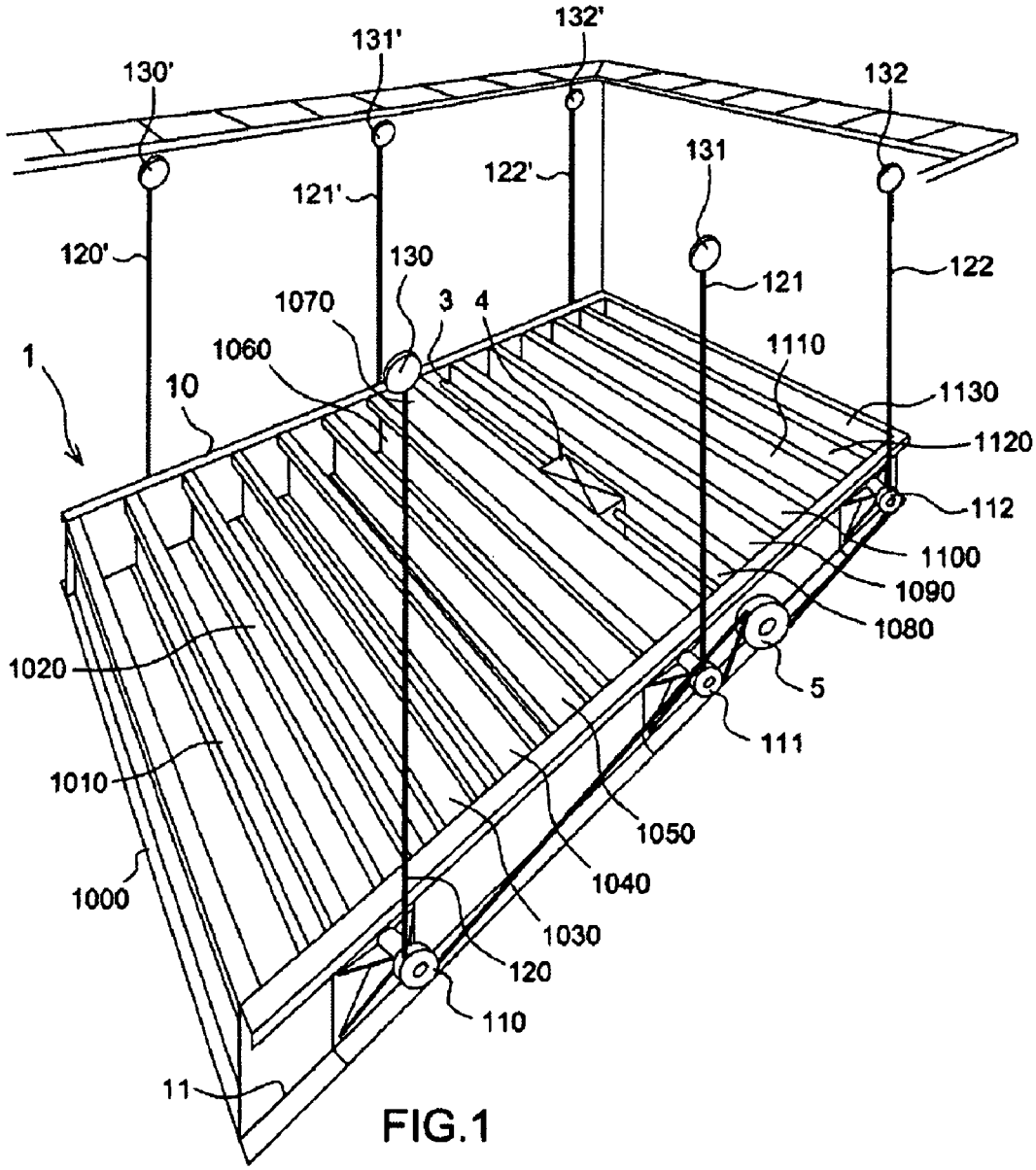
FIG. 1: a 3D view of the movable floor according to an embodiment of the invention for a swimming pool.

The movable floor 1 according to the invention is shown in one embodiment in FIG. 1. It comprises in this embodiment a structure comprising two lateral beams 10, 11 and a plurality of mutually parallel crossmembers 1000, 1010, 1020, 1030, 1040, 1050, 1060, 1070, 1080, 1090, 1100, 1110, 1120, 1130. The two crossmembers 1000, 1130 each positioned at one end of the structure form the frame of the structure with the lateral beams 10, 11. The space between two consecutive crossmembers is preferably from forty to fifty centimetres.

The movable floor according to an embodiment of the invention comprises a shaft 3 and a motor 4. The latter may be a winch type motor. The motor 4 drives the shaft 3 and the latter runs through the lateral beams 10, 11 in such a way as to be fixed to two pulleys 5, 5', one at each end of the shaft. These pulleys are called the "drive pulleys" in the rest of this description, although the drive function of the system is provided by the motor 4 and by the shaft 3. The assembly made up of the shaft 3 and the motor 4 will be referred to as the "drive shaft" 3, 4 in the following description.

The motor 4 is advantageously placed in a box 4' which is sealed by means of nitrogen. The box is placed between two crossmembers in such a way that its dimensions do not exceed the height of the structure and so do not introduce a loss of space.

In a variant, the box may noticeably exceed the height of the crossmembers without introducing a significant loss of space.

The drive provides the rotational movements of the shaft 3 in both directions in such a way as to drive the cables in one direction or the other and so either lower or raise the platform 1.

The drive pulleys 5, 5' of the drive shaft (3, 4) each drive a plurality of cables secured to the edge of the swimming pool. The cables are run around lateral pulleys 110, 110', 111, 111', 112, 112', referred to as "carrier pulleys" in the rest of this description, which are fixed to the two lateral beams 10, 11. The movable floor is thus kept horizontal by the cables and the distribution of the drive loads keeps the platform stable on its way up and down.

In a preferred embodiment, the movable swimming pool floor comprises two drive pulleys mounted on the drive shaft (3, 4) and six lateral carrier pulleys, in such a way that the carrier pulleys are positioned symmetrically about the longitudinal axis of the movable floor. In this latter case, each lateral beam 10, 11 comprises three carrier pulleys 110, 111, 112 and 110', 111', 112', respectively, distributed along the beam at a constant height.

The drive shaft (3, 4) drives the drive pulleys 5, 5'. These in turn drive the cables 1120, 120', 121, 121', 122, 122' wound respectively around the carrier pulleys 110, 110', 111, 111', 112, 112'. The driving loads of the cables on the carrier pulleys are distributed to the movable floor 1 as it moves up and down.

The cables 120, 120' 121, 121', 122, 122' are secured to the edge of the cavity forming the swimming pool by attachments 130, 130', 131, 131', 132, 132'.

Figure 2A:
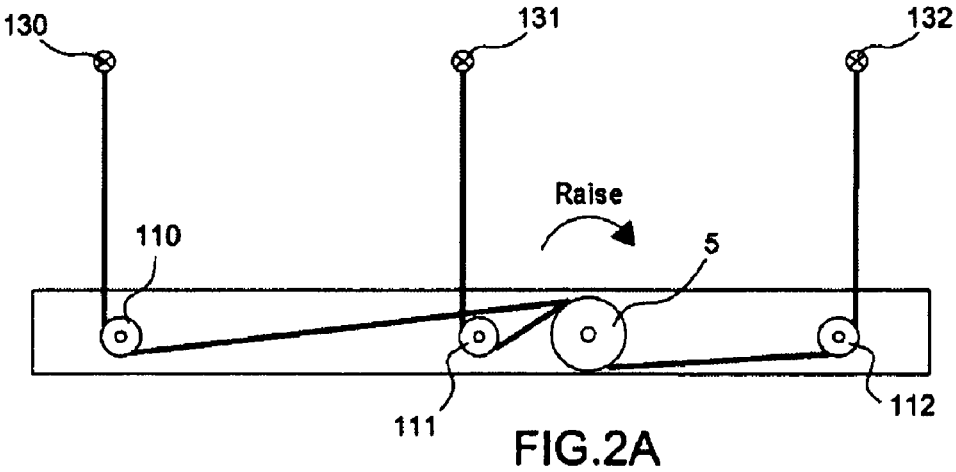
FIG. 2A: a first side view of the movable floor according to an embodiment of the invention.

FIG. 2A is a side view of the movable floor for a swimming pool, in which the three carrier pulleys 110, 111, 112 are shown along the side of the lateral beam 11. The cables 120, 121, 122 are secured to the respective attachment points 130, 131, 132 and wound around the carrier pulleys. Actuating the winch motor 4 causes the drive pulley 5 of the drive shaft (3, 4) to rotate in a direction such as to cause the movable floor 1 to be lifted by the action of the cables 120, 121, 122, 120', 121', 122'.

A descending direction causes the cables to unwind around the drive pulleys 5, 5' of the drive shaft (3, 4). As the carrier pulleys turn, the cables are released into the depth of the swimming pool, thus allowing the movable floor to descend.

Figure 2B:
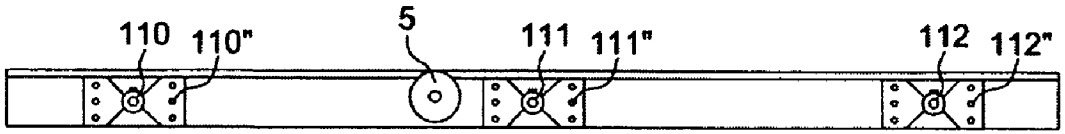
FIG. 2B: a second side view of the movable floor according to an embodiment of the invention.

FIG. 2B is a side view of the movable floor 1, showing fixing means 110", 111", 112" are shown for the carrier pulleys 110, 111, 112.

The drive shaft (3, 4) can be positioned equally satisfactorily between carrier pulleys 110 and 111, as between carrier pulleys 111 and 112.

Depending on the size of the swimming pool and therefore of the movable floor, variants may comprise more than three carrier pulleys on each of the edges of the lateral beams, in which case the drive shaft (3, 4) and the drive pulleys (5, 5') of the drive shaft may be positioned in a plane situated between two carrier pulleys preferably close to the centre of the movable floor.

In another variant (not shown), two motors may be used in separate boxes, each driving a drive shaft and each positioned between two crossmembers of the movable floor. This variant is particularly suitable for large areas corresponding to large cavities where large forces are required to drive the cables supporting the movable floor. In this situation a preferred arrangement for the two drive shafts is to position them on either side of the central axis of the movable floor, the central axis being parallel to the crossmembers. This arrangement allows the weight of the structure to be balanced, the motors being placed in sealed boxes between two crossmembers as described above. The two drive shafts drive, via drive pulleys, cables which do not interfere with each other.

Figure 3:
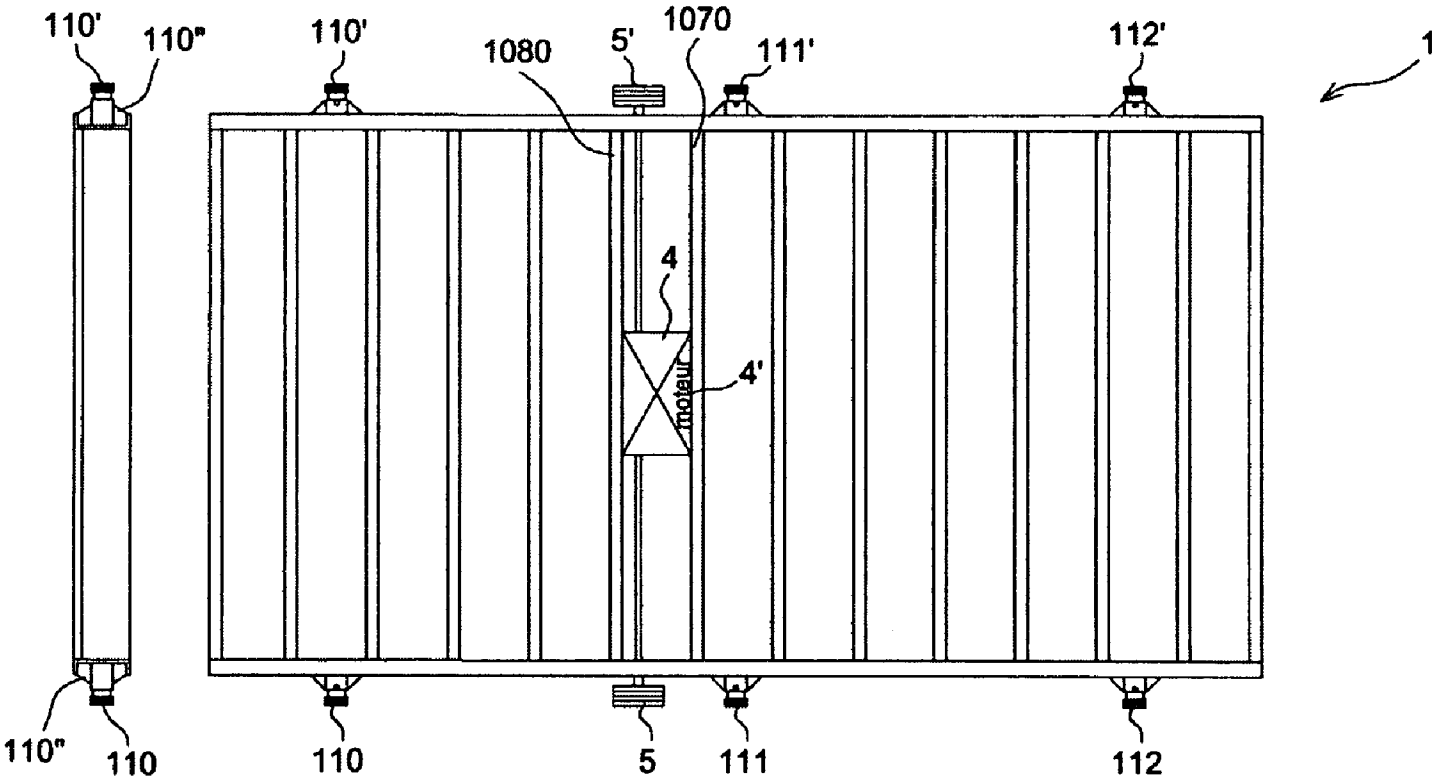
FIG. 3: a top view of the movable floor according to an embodiment of the invention.

FIG. 3 is a top view of a platform 1 of a movable floor for a swimming pool, showing the crossmembers and the motor 4 built into a box 4' positioned between two crossmembers 1070, 1080.

The carrier pulleys 110, 110', 111, 111', 112, 112' are arranged in such a way that the cables cannot interfere with the platform 1.

Moreover, in one preferred embodiment, the cables 120, 120', 121, 121', 122, 122' form several turns around each of the carrier pulleys so that they drive them in an upward and downward movement by the simple gripping force of the cables around each of the carrier pulleys.

Figure 4A:
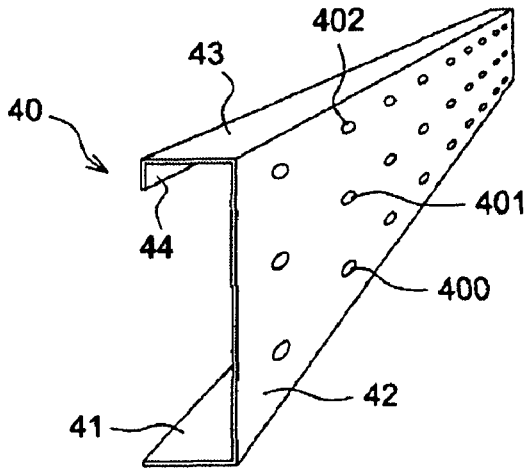
FIG. 4A: a 3D view of a beam of the frame of the platform according to an embodiment of the invention.

One preferred embodiment uses a C profile for the lateral beams 10, 11 of the platform. FIG. 4A is a 3D view of a lateral beam 40 used in the movable floor according to an embodiment of the invention. Such a profile for the beam 40 can be produced by bending.

The beam 40 comprises a first or lower horizontal edge 41, a second or upper horizontal edge 43, an edge forming a vertical lip 44, and the main face 42 of the beam. The edge 41 stiffens the structure when fixing a covering over the system.

The lateral beams 40 will preferably be perforated to facilitate assembly by means of nuts and bolts, in which case, in one embodiment, the main face 42 of the beam 40 comprises three rows of holes 400, 401, 402 to allow the crossmembers to be assembled by means of nuts and bolts.

In variants of the invention, depending on the size of the movable floor, a greater or lesser number of holes may be provided, spaced out at different distances, and the number of rows of holes may be two or conceivably even greater than or equal to four.

Figure 4B:
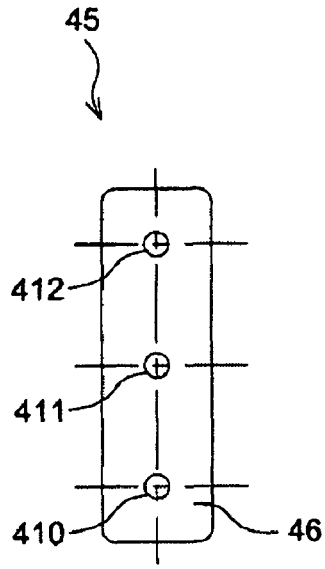
FIG. 4B: a plate designed to be fixed to the ends of a crossmember.

FIG. 4B shows a plate 45 designed to be welded to the ends of a crossmember 40. This plate thus allows the crossmembers to be bolted to each of the main faces 42 of the two lateral beams 40.

One face 46 of the plate 45 fixed to one end of the crossmember 40 comprises three holes 410, 411, 412 for the bolts to pass through.

The crossmembers may thus have the same profile as the lateral beams along their length, and at their ends have a lateral plate as described above. This solution allows the beams and the crossmembers to be made in the same way as each other. In the preferred embodiment, each plate 46 is fixed directly to the ends of each C-profiled crossmember by welding, but in another variant (not shown) the plates 45 have at least one lip designed to be fixed to a lip 41, 42 or 43 on the crossmember by bolting it for example to the crossmembers.

Figure 5:
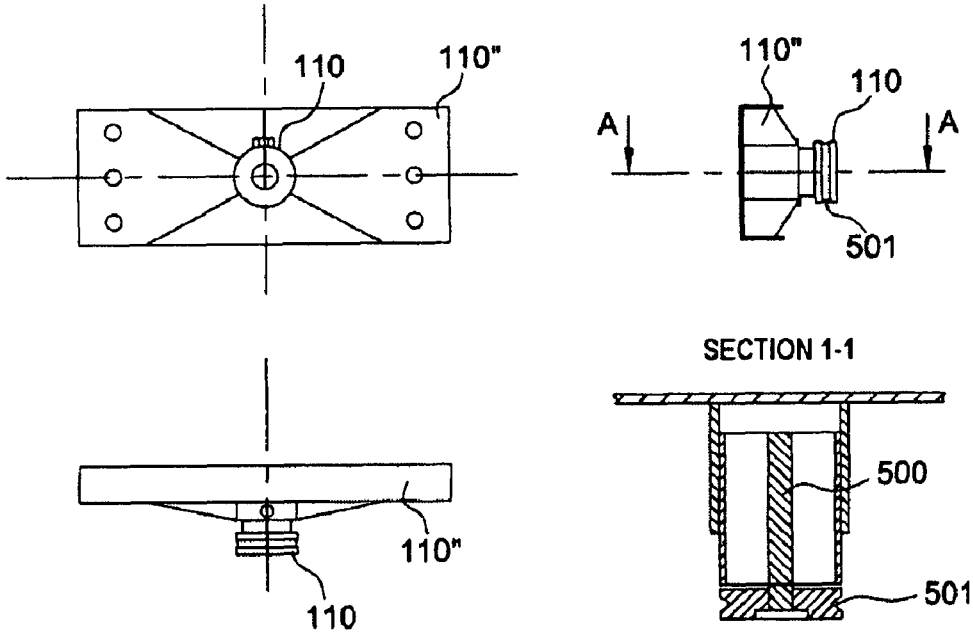
FIG. 5: an exploded view of a pulley supporting the lifting cables according to an embodiment of the invention.

FIG. 5 is an exploded view of a carrier pulley 110 with its fixing means as shown in FIG. 2B. A carrier pulley 110 rotates idly about a horizontal axis 500 perpendicular to the lateral beams 10, 11. The carrier pulley 110 is fixed by fixing means 110' attached to the lateral beams 10, 11. The fixing means in one embodiment each comprise, for example, a perforated plate and nuts and bolts.

The carrier pulley 110 turns as the platform is raised or lowered by the cable in the groove 501.

In a preferred embodiment, the width of the groove of the carrier pulleys is approximately equal to the diameter of the cable so as not to allow any looseness of the cable in the groove.

In addition, in a preferred embodiment, the drive pulleys (5, 5') of the drive shaft (3, 4) may have multiple grooves so that they can support each cable in a dedicated groove. This solution avoids the possible dangers of entanglement, snatching and jamming of the various cables against each other.

A finish covering is designed to be made over the platform 1. In a preferred embodiment, the finish covering comprises parallel slats with sufficient spacing between them to allow the water of the swimming pool to pass through the platform when the platform is lowered or raised.

In one embodiment, the finish covering roughly covers the surface area of the swimming pool. A space between the edges of the finish covering and the inside faces of the swimming pool allows water to pass through during lifting and lowering. The dimensions of this space allow the water to drain around the edges without interfering with the movements of the platform or the mounting force applied to it. This spacing is preferably a matter of a few centimetres, e.g. from 3 to 8 cm.

In the raised position, the platform covering is separated from the top edge of the swimming pool by less than one centimetre.

Between the lateral beams forming the frame of the movable floor and the inside edges of the cavity forming the swimming pool, the gap is partly occupied by a grating. This grating allows water to flow through it during upward or downward movements but provides safety by preventing the insertion of anything that might slip between the platform and the inside edges of the cavity.

In a variant, the finish covering comprises a door positioned in such a way as to allow access beneath the platform between two crossmembers. This door may be provided to allow a cleaning robot to be passed through, or to provide a passage to allow the motor 4 to be replaced, or to allow repairs requiring access beneath the platform.

In a variant, the finish covering and the structure made up of the frame 10, 11, 1000, 1130 and the crossmembers $\{i\}_{i\in[1010;1120]}$ is adapted to the surface of the bottom of the swimming pool.

In particular, the covering may partially incorporate a part adapted to cover a set of swimming pool steps with landings, this part not covering the frame.

In another embodiment, which combines with all the other embodiments discussed in this description, the structure comprises platform stabilizing means such as brushes fixed around the edges of the platform frame, the frame being formed by the lateral beams and end crossmembers 1000, 1130. The brushes advantageously point toward the inside walls of the swimming pool.

The brushes in this arrangement allow the passage of water during the descending and ascending movements of the platform 1 while providing a flexible contact between the platform and the vertical edges serving as the cavity of the swimming pool. The advantage of such a system is that it prevents rocking movements of the platform within the swimming pool cavity.

The brush system acts as a platform stabilizing means.

An embodiment of the invention allows control of the motor 4 to be moved to, actuating means comprising a simple box with control buttons offering a lever or button for lifting and a lever or button for lowering. Furthermore, a key can be used to ensure safe use of the buttons. In one particular embodiment, the buttons are push buttons, thus ensuring that there can be no movement of the movable floor in the cavity when there is no pressure on the button.

The actuating means may control the motor 4 by an electrical system in which the wires connecting the control box to the motor 4 are placed in such a way as not to interfere with the movements of the platform.

The actuating means allow the movable floor to be positioned at a desired depth within the cavity, and the chosen depth may be between the bottom of the swimming pool and the surface of the swimming pool.

The movable swimming pool floor advantageously allows a swimming pool to be converted into a paddling pool.

In one embodiment, manual lifting or lowering means are combined with the motor means referred to above in the present description. Such means may be made from a hand pump, for example, to allow the platform to be raised or lowered in the event of a breakdown.

In one particular embodiment of a cavity comprising floors with different depths, the movable floor comprises separate structures, each with their own covering. This embodiment allows all the coverings, when positioned side by side, to cover effectively the entire surface of the cavity.

In one embodiment that combines with the preceding embodiments set out in this description, the side wall of the cavity forming the swimming pool comprises a plurality of sensors to detect the presence or absence of the platform at a certain height or to directly detect their height. With such a system the platform can be positioned at a predetermined desired height by a command given to the motor actuating system, for example.

Finally, one embodiment allows a mechanical brake to be sited close to the edge of the swimming pool and/or directly on the motor actuating means to ensure the safety of the movements of the platform 1 if any manoeuvre required that the movement of the platform be brought to an emergency stop.

The invention claimed is:

1. A movable floor system for a swimming pool, the movable floor system comprising:

a frame installable in a cavity acting as the swimming pool, the frame comprising:

a plurality of outer lateral edges, the plurality of outer lateral edges including at least a first side and a second side, the second side located substantially opposite from the first side, the frame forming a layer configured to support a finished covering; and a plurality of crossmembers, a first end of each crossmember attached to the first side of the frame, and a second end of each crossmember attached to the second side of the frame; and a lifting mechanism comprising:

a driver mounted inside the frame;

a shaft having a first end attached to the first side of the frame and a second end attached to the second side of the frame;

a first drive pulley situated at the first end of the shaft, and a second drive pulley situated at the second end of the shaft, the first and second drive pulleys designed to accommodate platform driving cables;

an attachment to secure at least four cables in the cavity; and a plurality of carrier pulleys disposed on the first side and the second side between crossmembers of the frame;

wherein the drive pulleys engage with the at least four cables, and the at least four cables further engage with the carrier pulleys.

2. The movable floor system of claim 1, wherein the driver is mounted inside the frame between two predetermined crossmembers of the plurality of crossmembers, and lifting mechanism further comprises an actuator for actuating the driver.

3. The movable floor system for a swimming pool according to claim 1, wherein the frame further comprises two lateral beams and two transverse crossmembers forming at least a portion of the outer lateral edges of the frame.

4. The movable floor system for a swimming pool according to claim 3, wherein a linear dimension of the driver in a direction perpendicular to a plane of the frame is less than a height of the frame.

5. The movable floor system for a swimming pool according to claim 4, wherein the driver includes a winch motor to drive the movable floor in the cavity.

6. The movable floor system for a swimming pool according to claim 2, wherein the actuator enables the frame to be positioned at a desired depth between a floor of the cavity and a horizontal surface extending from an upper edge of the cavity.

7. The movable floor system for a swimming pool according to claim 5, wherein a sealed box encloses the winch motor and nitrogen gas.

8. The movable floor system for a swimming pool according to claim 4, further comprising a dual drive to lower and to raise the frame by winding the cables a plurality of times around the first and second drive pulleys.

9. The movable floor system for a swimming pool according to claim 8, further comprising a stabilizer to stabilize the frame laterally when the frame is lowered or raised.

10. The movable floor system for a swimming pool according to claim 9, wherein the stabilizer comprises a plurality of brushes arranged along at least a portion of the plurality of outer lateral edges of the frame to provide a contact between the frame and one or more walls of the cavity.

11. The movable floor system for a swimming pool according to claim 8, wherein the frame comprises a door.

12. The movable floor system for a swimming pool according to claim 1, wherein the crossmembers are attached to the frame by a plurality of nuts.

13. The movable floor system for a swimming pool according to claim 1, wherein a finished covering covers the crossmembers attached to the frame.

14. The movable floor system for a swimming pool according to claim 13, wherein the finished covering comprises a plurality of openings to allow sufficient water to pass through so that mobility of the movable floor system is not hampered.

15. The movable floor system for a swimming pool according to claim 14, wherein a grating is attached along at least a portion of the plurality of outer lateral edges of the frame to prevent a foreign body getting between an edge of the cavity and the movable floor while allowing water to pass through when the movable floor is lowered or raised.

16. The movable floor system for a swimming pool according to claim 15, wherein, in a closed position, a distance between the finished covering of the movable floor and the edge of the cavity is less than 1 cm.

* * * * *